US010744363B1

(12) United States Patent
Jaquish et al.

(10) Patent No.: US 10,744,363 B1
(45) Date of Patent: Aug. 18, 2020

(54) EXERCISE APPARATUS

(71) Applicant: Jaquish Biomedical Corporation, Nevada City, CA (US)

(72) Inventors: John Paul Jaquish, Nevada City, CA (US); Paul Edward Jaquish, Nevada City, CA (US); Henry David Alkire, Nevada City, CA (US)

(73) Assignee: Jaquish Biomedical Corporation, Nevada City, CA (US)

( * ) Notice: Subject to any disclaimer, the term of this patent is extended or adjusted under 35 U.S.C. 154(b) by 63 days.

(21) Appl. No.: 16/283,432

(22) Filed: Feb. 22, 2019

(51) Int. Cl.

| | |
|---|---|
| ***A63B 21/00*** | (2006.01) |
| ***A63B 24/00*** | (2006.01) |
| ***A63B 21/04*** | (2006.01) |
| ***A63B 21/055*** | (2006.01) |

(52) U.S. Cl.
CPC .. *A63B 21/00196* (2013.01); *A63B 21/00061* (2013.01); *A63B 21/0442* (2013.01); *A63B 21/0557* (2013.01); *A63B 21/4033* (2015.10); *A63B 21/4035* (2015.10); *A63B 24/0087* (2013.01); *A63B 21/00178* (2013.01); *A63B 2220/56* (2013.01); *A63B 2220/833* (2013.01)

(58) Field of Classification Search
CPC ..... A63B 21/00061; A63B 21/0557; A63B 21/0442; A63B 21/00196; A63B 21/4033; A63B 21/4035; A63B 21/00047; A63B 21/00178; A63B 21/0087; A63B 2220/56; A63B 2220/833
See application file for complete search history.

(56) References Cited

U.S. PATENT DOCUMENTS

| | | | | |
|---|---|---|---|---|
| 9,283,420 | B2 * | 3/2016 | Seaton | A61H 1/005 |
| 9,327,164 | B2 * | 5/2016 | Morris | A63B 7/00 |
| D778,374 | S * | 2/2017 | Jaquish | D21/686 |
| 10,045,647 | B2 * | 8/2018 | Publicover | A63B 22/18 |
| 10,124,202 | B2 * | 11/2018 | Bailar | A63B 21/0414 |
| 2006/0200054 | A1 * | 9/2006 | Talish | A61H 23/02 601/98 |

(Continued)

OTHER PUBLICATIONS

Cardinale et al. "Whole Body Vibration Exercise: Are Vibrations Good for You?" British Journal of Sports Medicine, vol. 39, pp. 585-589 (2005).

(Continued)

*Primary Examiner* — Megan Anderson
(74) *Attorney, Agent, or Firm* — Morgan, Lewis & Bockius LLP

(57) ABSTRACT

An exercise device comprises a base. A power mechanism and a vibration mechanism are each disposed in the base. The power mechanism powers the vibration mechanism. The vibration mechanism provides linear vibrations through the base of the device in a first axis parallel to a longitudinal axis of a user standing on the base. In some embodiments, the device is substantially free of vibration in a plane orthogonal to the first axis and is substantially free of rotational vibration in any direction at a time when the vibration mechanism provides the first plurality of linear vibrations. In some embodiments, the vibration mechanism operates between 10 and 60 Hz. In some embodiments an exercise kit is provided that includes the referenced exercise device, an exercise bar, and one or more elastic bands, each elastic band for removably coupling the base to the exercise bar.

20 Claims, 7 Drawing Sheets

(56) References Cited

U.S. PATENT DOCUMENTS

| | | | | |
|---|---|---|---|---|
| 2007/0270726 | A1* | 11/2007 | Chou | A63B 21/00196 601/70 |
| 2011/0294635 | A1* | 12/2011 | Morris | A61H 23/0254 482/146 |
| 2016/0263424 | A1* | 9/2016 | LaCaze | A63B 21/4035 |
| 2019/0262209 | A1* | 8/2019 | Grbic | A63B 21/00178 |
| 2020/0038277 | A1* | 2/2020 | Chang | A63B 22/00 |

OTHER PUBLICATIONS

Marin et al. "The Addition of Synchronous Whole-Body Vibration to Battling Rope Exercise Increases Skeletal Muscle Activity" Journal of Musculoskeletal Neuronal Interactions, vol. 15, pp. 240-248 (2015).

Morel et al. "Effects of Whole Body Vibration Intervention on Handgrip Strength of Brazilian Healthy Soldiers" African Journal of Traditional Complementary and Alternative Medicines, vol. 14, pp. 28-32 (2017).

Rauch et al. "Reporting Whole-Body Vibration Intervention Studies: Recommendations of the International Society of Musculoskeletal and Neuronal Interactions" Journal of Musculoskeletal Neuronal Interactions, vol. 10, pp. 193-198 (2010).

Rittweger "Vibration as an Exercise Modality: How it may work, and what its potential might be" European Journal of Applied Physiology, vol. 108, pp. 877-904 (2010).

* cited by examiner

EXERCISE APPARATUS

FIELD

The present disclosure relates generally to exercise apparatuses. More particularly, the present disclosure pertains to improved exercise apparatuses that include an automatic power switch.

BACKGROUND

A core basis of exercising is lifting a weight vertically against a force of gravity. These vertical motions, instead of horizontal or circular motions, are reproduced in fundamental exercises including the deadlift, the squat, and the bent row. Additionally, core biomechanical movements, such as walking and running, involve the feet, the arms, and the legs of a subject moving up and down in a vertical plane. Each step induces a vibration in the body that causes the muscles to contract or relax in order to sustain a balanced body position. These reflexes are involuntary and occur over a near instantaneous period of time, much like a knee jerk reaction.

As a result, performing body mass resistive exercises on a whole-body vibration (WBV) platform has become an increasingly popular training modality. Indeed, a visit at the local gym will demonstrate how popular vibration exercises currently are, with numerous devices available for exercise and physical therapy. Vibration is oscillatory motion about an equilibrium point, as illustrated in FIG. 7. Vibration is a mechanical oscillation, e.g. a periodic alteration of force, acceleration and displacement over time. Vibration exercise, in a physical sense, is a forced oscillation, where energy is transferred from an actuator (e.g. the vibration device) to a resonator (e.g. the human body, or parts of it). In many vibration exercise devices, these oscillations have sinusoidal shape, and they are therefore described by amplitude A, frequency f, and phase angle $\varphi$. As illustrated in FIG. 7, "A" denotes the mathematical amplitude, i.e. half the peak-to-peak displacement (D). The angular frequency $\omega$ is given as $2\pi f$. During a vibration exercise, the human body is accelerated, which causes a reactive force by and within the human body.

The vertical oscillations generated via a ground based platform induce short and rapid changes in skeletal muscle fiber length (see, Marin et al., 2015, "The addition of synchronous whole-body vibration to battling rope exercise increases skeletal muscle activity," J. Musculoskelet Neuronal Interact 15(3), 240-248; Cardinale, 2003, "The use of vibration as an exercise intervention," Exerc Sport Sci Rev 31, 3-7; Hagbarth and Eklund, 1966, "Tonic vibration reflexes (TVR) in spasticity," Brain Res 2:201-3; and Ritzmann et al., 2010, "EMG activity during whole body vibration: motion artifacts or stretch reflexes?," Eur J Appl Physiol 110, 143-51, each of which is hereby incorporated by reference), which presumably stimulate reflexive muscle contractions increasing skeletal muscle activity. See, Ritzmann, Id., Abercromby et al., 2007, "Variation in neuromuscular responses during acute whole-body vibration exercise," Med Sci Sports Exerc 39, 1642-50; Cardinale and Lim, 2003, "Electromyography activity of vastus lateralis muscle during whole-body vibrations of different frequencies," J Strength Cond Res 17, 621-4; Hazell et al., 2007, "The effects of wholebody vibration on upper- and lower-body EMG during static and dynamic contractions," Appl Physiol Nutr Metab 32:1156-63; Hazell et al., 2010, "Evaluation of muscle activity for loaded and unloaded dynamic squats during vertical whole-body vibration," J Strength Cond Res 24, 1860-5; Marin et al., 2009, "Neuromuscular activity during whole-body vibration of different amplitudes and footwear conditions: implications for prescription of vibratory stimulation," J Strength Cond Res 23:2311-6; Marin et al., 2012, "Acute effects of whole-body vibration on neuromuscular responses in older individuals: implications for prescription of vibratory stimulation," J Strength Cond Res 26:232-9; Ritzmann et al., 2013, "The influence of vibration type, frequency, body position and additional load on the neuromuscular activity during whole body vibration, Eur J Appl Physiol 113, 1-11; Roelants et al., 2006, "Whole-body-vibration-induced increase in leg muscle activity during different squat exercises, J Strength Cond Res 20:124-9; Osawa and Oguma, 2013 "Effects of resistance training with whole-body vibration on muscle fitness in untrained adults," Scand J Med Sci Sports 23, 84-95, each of which is hereby incorporated by reference.

The magnitude of these increases in skeletal muscle activity measured via electromyography (EMG) is dependent on the characteristics of the WBV stimulus (amplitude, size of each deflection) with higher frequencies and amplitude inducing greater muscle activity. See, Hazell et al., 2007, "The effects of wholebody vibration on upper- and lower-body EMG during static and dynamic contractions," Appl Physiol Nutr Metab 32, 1156-63; Ritzmann et al., 2013, "The influence of vibration type, frequency, body position and additional load on the neuromuscular activity during whole body vibration," Eur J Appl Physiol 113, 1-11; and Marin et al., 2012, "Whole-body vibration increases upper and lower body muscle activity in older adults: potential use of vibration accessories," J Electromyogr Kinesiol 22:456-62, each of which is hereby incorporated by reference.

One design goal of existing exercise equipment has been to reproduce fundamental exercises on stable stationary platforms. To this end, existing exercise equipment has been designed with the goal of reproducing the naturally induced vibrations of the body. One approach for achieving this goal in existing exercise equipment has been to include a vibration mechanism attached in such equipment. However, such existing equipment, while successful in producing vibrations in an effort to reproduced the naturally induced vibrations of the body, has been unsatisfactory because there is no convenient way to turn on and off the vibrations. Once a user is on the device, it is inconvenient to have the user bend down and turn on the vibration source. Conversely, requiring a user to turn on the vibration source before getting onto the device causes the device, now turned on but without a user standing on the device, to jump around. Besides being inconvenient, this can be dangerous and can cause damage to other equipment that is typically in a gym, such as wall mounted mirrors.

As such, conventional equipment has also been unsatisfactory because it requires the exerciser to manually operate the vibration mechanism between exercise sets. Otherwise, the equipment will continue to vibrate when the user is unengaged with the equipment, moving and skittering across the ground. One solution for addressing such problems is to engineer such equipment so that it is very heavy, and thus will tend not to move and skitter when in vibrational operation without a user standing on the equipment. But this approach is unsatisfactory because it is difficult to move such equipment due to its excessive weight. Thus, advances in the design of such equipment is needed in order to increase stability and allow an exerciser to operate the device in a more convenient manner.

Given the above disclosure, what is needed in the art are improved vibrational exercise devices.

SUMMARY

The present disclosure addresses the above-identified shortcomings. Improved exercise devices are provided.

In accordance with some embodiments, a vibration exercise device is provided. In some embodiments the exercise device is a synchronous vibration device. In some alternative embodiments, the exercise device is a side alternating vibration device.

The exercise device includes a base, a power mechanism disposed within the base, and a vibration mechanism disposed within the base.

The power mechanism includes a control mechanism that operates the power mechanism between a first state and a second state. In the first state, the vibration mechanism provides a plurality of vibrations through the base of the exercise device. In some embodiments, the plurality of vibrations are synchronous linear vibrations propagated in a first axis that is parallel to a longitudinal axis of a user of the exercise device when the user is standing on the base. In the second state the vibration mechanism is turned off.

The control mechanism senses when a user is standing on the base and, responsive to a user standing on the base, causes the power mechanism to switch from the second state to the first state. Corresponding, responsive to a user getting off the base, the control mechanism causes the power mechanism to switch from the first state to the second state.

In some embodiments, the base of the exercise device is substantially free of vibration in a plane orthogonal to the first axis. Further, the base of the exercise device is substantially free of rotational vibration in any direction at a time when the vibration mechanism provides the first plurality of linear vibrations.

In some embodiments, the vibration mechanism operates at a frequency of between 10 Hertz (Hz) and 60 Hz.

In some embodiments, the base includes an upper portion that is configured to accommodate a user of the device. In such embodiments, the base also includes and a lower portion that is configured to abut a surface of an external environment. In some embodiments, the lower portion of the base and the upper portion of the base are molded together.

In some embodiments, the upper portion of the base includes a protrusion that surrounds an outer edge portion thereof. In some embodiments, the protrusion includes a groove. The groove runs from a first end portion of the base to a second end portion of the base. In some embodiments, the groove is configured to accommodate one or more elastic bands.

In some embodiments, the upper portion of the base includes a cover. The cover is coupled to an upper end portion of the protrusion. In some embodiments, the cover includes a grip surface.

In some embodiments, the control mechanism is disposed on the upper portion of the base. In some embodiments, the control mechanism is disposed interposing between the upper portion of the base and the cover. In some embodiments, the control mechanism includes a button. In some embodiments, the control mechanism operates the power mechanism between a first state in which the vibration mechanism provides vibrations through the exercise device in a first axis that is parallel to a longitudinal axis of a user of the exercise device when the user is standing on the base, and a second state in which the vibration mechanism is turned off. In some embodiments, a first position of the button corresponds to the first state, and a second position of the button corresponds to the second state. In some embodiments, the button is partially disposed in a seat on the upper surface of the device. In some embodiments, the control mechanism includes a pressure sensor.

In some embodiments, the lower portion of the base includes a plurality of legs. In some embodiments, each leg in the plurality of legs includes a damper.

In some embodiments, each leg in the plurality of legs includes an upper portion that is coupled to the base and a lower portion that is coupled to the upper portion of the leg and abuts the surface of the external environment.

In some embodiments, the present disclosure provides an exercise device. The exercise device includes a base and a cover that is disposed on an upper portion of the base. A power mechanism is disposed interposing the base and the cover. The power mechanism is configured to supply power to a vibration mechanism disposed on the base if a user of the device engages the cover.

In some embodiments, the present disclosure provides an exercise device. The exercise device includes a base, a protrusion disposed on a circumference of the base, and a cover that is removably coupled to the protrusion. A power mechanism is disposed at an internal portion of the circumference of the protrusion interposing the base and the cover. The power mechanism supplies power to a vibration mechanism disposed on the base if a pressure is applied to the cover.

In some embodiments, the present disclosure provides an exercise kit. The exercise kit includes an exercise bar as described herein. The exercise kit also includes a base. Further, the exercise kit includes one or more elastic bands. Accordingly, an elastic band in the one or more elastic bands removably couple the base to the exercise bar.

In some embodiments, the exercise kit includes at least three elastic bands of different resistances.

BRIEF DESCRIPTION OF THE DRAWINGS

For a better understanding of the disclosed embodiments, reference should be made to the Description of Embodiments below, in conjunction with the following drawings in which like reference numerals refer to corresponding parts throughout the figures.

The implementations disclosed herein are illustrated by way of example, and not by way of limitation, in the figures of the accompanying drawings. Like reference numerals refer to corresponding parts throughout the drawings.

DESCRIPTION OF EMBODIMENTS

Figure 1:
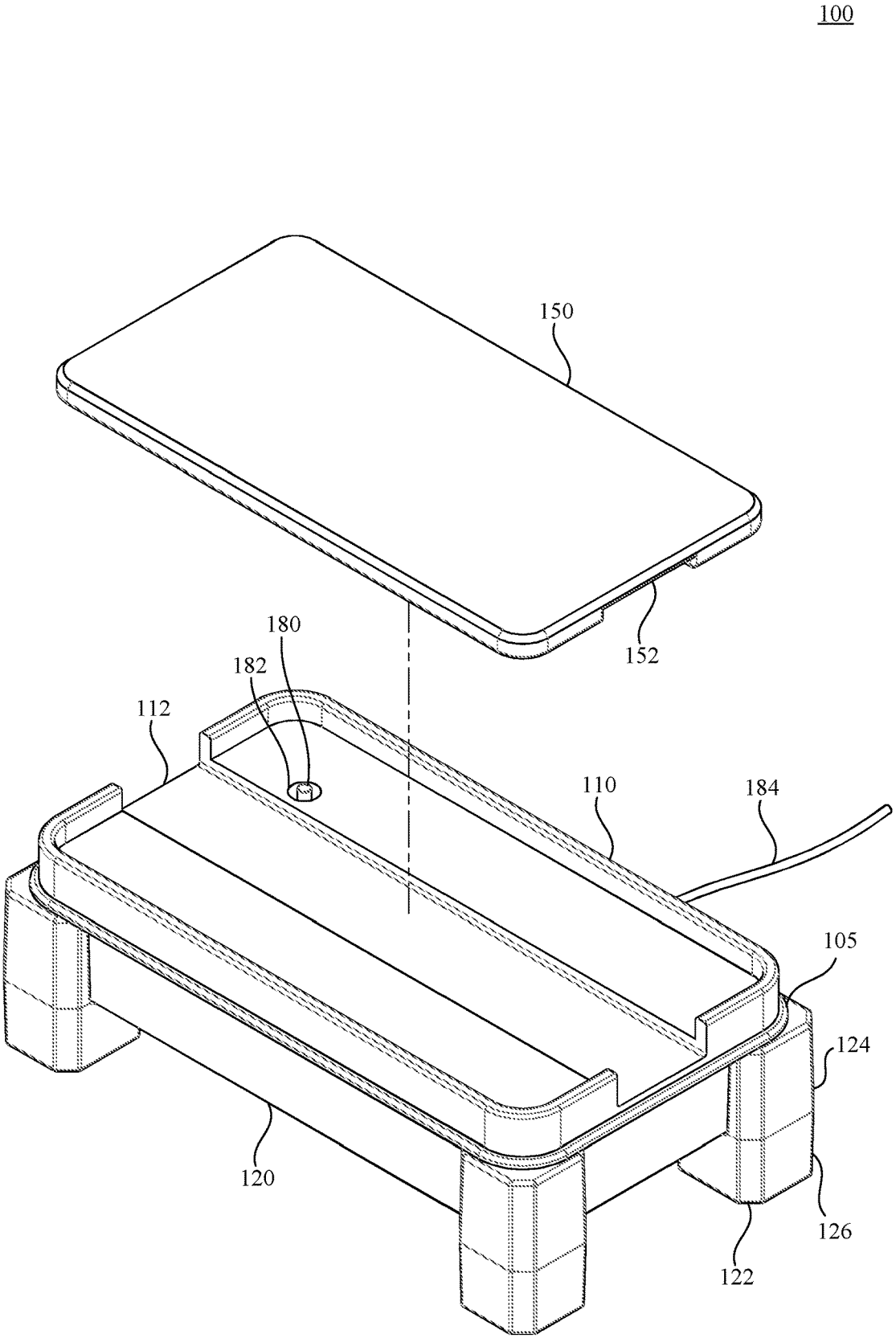
FIG. 1 illustrates a partially exploded view of an exercise device, in accordance with an embodiment of the present disclosure.

Reference will now be made in detail to embodiments, examples of which are illustrated in the accompanying drawings. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, circuits, and networks have not been described in detail so as not to unnecessarily obscure aspects of the embodiments.

Plural instances may be provided for components, operations or structures described herein as a single instance. Finally, boundaries between various components, operations, and data stores are somewhat arbitrary, and particular operations are illustrated in the context of specific illustrative configurations. Other forms of functionality are envisioned and may fall within the scope of the implementation(s). In general, structures and functionality presented as separate components in the example configurations may be implemented as a combined structure or component. Similarly, structures and functionality presented as a single component may be implemented as separate components. These and other variations, modifications, additions, and improvements fall within the scope of the implementation(s).

It will also be understood that, although the terms "first," "second," etc. may be used herein to describe various elements, these elements should not be limited by these terms. These terms are only used to distinguish one element from another. For example, a first elastic band could be termed a second elastic band, and, similarly, a second elastic band could be termed a first elastic band, without departing from the scope of the present disclosure. The first elastic band and the second elastic band are both elastic bands, but they are not the same elastic band. Further, the terms "exerciser," "end user," and "user" are interchangeable.

The terminology used herein is for the purpose of describing particular implementations only and is not intended to be limiting of the claims. As used in the description of the implementations and the appended claims, the singular forms "a", "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined (that a stated condition precedent is true)" or "if (a stated condition precedent is true)" or "when (a stated condition precedent is true)" may be construed to mean "upon determining" or "in response to determining" or "in accordance with a determination" or "upon detecting" or "in response to detecting" that the stated condition precedent is true, depending on the context.

For purposes of explanation, numerous specific details are set forth in order to provide an understanding of various implementations of the inventive subject matter. It will be evident, however, to those skilled in the art that implementations of the inventive subject matter may be practiced without these specific details. In general, well-known structures and techniques have not been shown in detail.

The foregoing description, for purpose of explanation, has been described with reference to specific implementations. However, the illustrative discussions below are not intended to be exhaustive or to limit the implementations to the precise forms disclosed. Many modifications and variations are possible in view of the above teachings. The implementations are chosen and described in order to best explain the principles and their practical applications, to thereby enable others skilled in the art to best utilize the implementations and various implementations with various modifications as are suited to the particular use contemplated.

In the interest of clarity, not all of the routine features of the implementations described herein are shown and described. It will be appreciated that, in the development of any such actual implementation, numerous implementation-specific decisions are made in order to achieve the designer's specific goals, such as compliance with use case- and business-related constraints, and that these specific goals will vary from one implementation to another and from one designer to another. Moreover, it will be appreciated that such a design effort might be complex and time-consuming, but nevertheless be a routine undertaking of engineering for those of ordering skill in the art having the benefit of the present disclosure.

For convenience in explanation and accurate definition in the appended claims, the terms "upper," "lower," "up," "down," "upwards," "downwards," "laterally, "longitudinally," "inner," "outer," "inside," "outside," "inwardly," "outwardly," "interior," "exterior," "front," "rear," "back," "forwards," and "backwards" are used to describe features of the exemplary embodiments with reference to the positions of such features as displayed in the figures.

In general, a vibration exercise device of the present disclosure includes an automated power mechanism that activates the device upon engagement with the device by a user (e.g., the exerciser). This automated power mechanism allows the user to perform various exercises using the exercise device of the present disclosure with minimal downtime (e.g., prevents redundant operations such as manually operating the on and off states of the device between sets of exercises). The exercise device also includes a vibration mechanism that provides a source of vibrations. In some embodiments these vibrations are synchronous vibrations in a vertical plane. In alternative embodiments, these vibrations are not synchronous. In some embodiments, the vibrations are side alternating vibrations as disclosed in Rauch et al., 2010, "Reporting whole-body vibration intervention studies: Recommendations of the International Society of Musculoskeletal and Neuronal Interactions," J. Musculoskelet Neuronal Interact 10(3), 193-198, which is hereby incorporated by reference. Without intending to be limited to any particular theory, it is believed that the disclosed vibration mechanism increases an efficiency of performing a given exercise for the user, by promoting muscle growth and/or rehabilitation through the vibrations provided by the vibration mechanism.

Moreover, in those embodiments where the vibrations are limited to synchronous vibrations propagated vertically, through a subject standing on the exercise device, it is believed that the vibrations advantageously provide a stable platform for the user to perform exercises on since there are no horizontal or circular motions that may create instability for the user.

The vibrations generated by the disclosed devices also provide instantaneous acceleration to the body of the user, which further enhances the gravitational forces experienced by the body to promote muscle growth and/or rehabilitation. In some embodiments, this acceleration is in the range of 2 g to 5 g, where 1 g is acceleration equivalent to the Earth's gravitational field—9.81 meter/second$^2$ (m/s$^2$). In some embodiments, this acceleration is in the range of 2 g to 16 g. In some embodiments, this acceleration is in the range of 5 g to 15 g.

Since the vibration mechanism is advantageously automatically powered by the power mechanism when a user is engaged with (e.g., standing on) the device, the device does not skitter and move unnecessarily due to vibrations when the user is not engaged with the device.

Referring to FIGS. 1 through 6, a vibration exercise device 100 is provided for enhancing an efficiency of exercising for a user (e.g., providing a convenience to the user via an automated power mechanism, etc.).

In some embodiments, the vibration exercise device 100 is a synchronous vibration device. As used herein, the term "synchronous vibration" refers to a vibration that oscillates one or more portions of the device 100 with identical displacement and acceleration (e.g., each portion of a surface of the device is in phase). Accordingly, when a synchronous vibration is provided through the exercise device 100 each portion of the device 100 has a same displacement at a point in time. In comparison, an alternating vibration provides a vibration through the device 100 where a first portion of the device is at a first displacement at a point in time and a second portion of the device is at a second displacement, which is different than the first displacement, at the point in time. In some alternative embodiments, the vibration exercise device 100 is an alternating vibration device.

The exercise device 100 includes a base (e.g., base 120 of FIG. 1) and a power mechanism (e.g., power mechanism 310 of FIG. 3) that provides electrical power to one or more components (e.g., a vibration mechanism, a power indicator, etc.) of the device 100. In some embodiments, the power mechanism 310 is disposed within the base 120. For instance, in some embodiments the power mechanism 310 is disposed in an internal portion of the base 120 (e.g., a cord 184 is the only visible component of the power mechanism to a user of the device 100). Furthermore, in some embodiments the power mechanism 310 is disposed on a surface of the exercise device 100. For instance, in some embodiments the power mechanism 310 is disposed on a bottom surface of the base 120. In some embodiments, the power mechanism 310 is disposed on a side surface of the base 120. Additional details and information related to the power mechanism will be described in more detail infra.

In some embodiments, the base 120 includes an upper portion 105 that is configured to accommodate a user of the device 100 (e.g., support a user that is standing on the upper portion of the base). In some embodiments, the base 120 is made of metal (e.g., aluminum, steel, iron, nickel, etc.). In some embodiments, the base 120 is made, at least in part, with austenite steel (e.g., AISI type no. 201, 202, 301, 302, 302B, 303, 303 (Se), 304, 304L, 305, 308, 309, 309S, 310, 310S, 314, 316, 317, 321, 347, or 348, etc.), a martensitic steel (e.g., AISI type no. 403, 410, 414, 416, 416(Se), 420, 420F, 431, 440A, 440B, 440C, or 501, etc.), or a ferritic steel (AISI type no. 405, 429, 430, 430F, 430F(Se), 442, 446, 502) such as those described in Table 6.2.18a of Marks' *Standard Handbook for Mechanical Engineers*, ninth edition, 1987, McGraw-Hill, Inc., at p. 6-37. In some embodiments, the base 120 is made of a nickel alloy (e.g., Nickel 270, Nickel 200, Duranickel 301, Monel 400, Monel K-500, Hastelloy C, Incoloy 825, Inconel 600, Inconel 718, or TD Ni) such as those described in Table 6.4.7 of Marks' *Standard Handbook for Mechanical Engineers*, ninth edition, 1987, McGraw-Hill, Inc., at p. 6.72, which is hereby incorporated by reference. In some embodiments, the base 120 is made of a high-strength low-alloy steel (HSLA). HSLA is a type of alloy steel that provides better mechanical properties or greater resistance to corrosion than carbon steel. In some embodiments the HSLA steel has a carbon content between 0.05-0.25%. In some embodiments, the HSLA steel includes up to 2.0% manganese and small quantities of copper, nickel, niobium, nitrogen, vanadium, chromium, molybdenum, titanium, calcium, rare earth elements, or zirconium. For more disclosure on HSLA steel that can be used to make the base 120, see Degarmo et al., 2003, *Materials and Processes in Manufacturing* (9th ed.), Wiley, ISBN 0-471-65653-4, and Oberg et al., 1996, *Machinery's Handbook* (25th ed.), Industrial Press Inc., each of which is hereby incorporated by reference. Including a metal material in the base 120 provides for a sturdier, more stable exercise device 100, while also increasing a load bearing capacity of the device 100. In some embodiments, the base 120 includes a rubber material. For instance, in some embodiments the base 120 (e.g., a cover 150), includes a coat of material with GR-S, neoprene, a nitrile rubber, a butyl rubber, a polysulfide rubber, or an ethylene-propylene rubber (e.g., ethylene propylene diene methylene (EPDM) rubber), a cyclized rubber (e.g., Thermoprene). See for example, Sections 6-161 through 6-163 of Marks' *Standard Handbook for Mechanical Engineers*, ninth edition, 1987, McGraw-Hill, Inc., beginning at p. 6.161, which is hereby incorporated by reference.

In some embodiments, the base 120 is about 10 inches (ins) wide. In some embodiments, the base 120 is about 12.5 ins wide. In some embodiments, the base 120 is about 15 ins wide. In some embodiments, the base 120 is about 17.5 ins wide. In some embodiments, the base 120 is about 20 ins wide. In some embodiments, the base 120 is about 24 ins wide. In some embodiments, the base 120 is about 30 ins wide. In some embodiments, the base 120 is about 36 ins wide. In some embodiments, the base 120 is about 42 ins wide. In some embodiments, the base 120 is about 48 ins wide. In some embodiments, the base 120 is about 54 ins wide. In some embodiments, the base 120 is about 60 ins wide. In some embodiments, the base 120 is about 66 ins wide. In some embodiments, the base 120 is about 72 ins wide. In some embodiments, the base 120 is about 78 ins wide. In some embodiments, the base 120 is about 84 ins wide. Accordingly, in some embodiments the base 120 has a width in a range of 10 to 84 ins. In some embodiments, the base 120 has a width in a range of 15 to 30 ins. In some embodiments, the base 120 has a width in a range of 15 to 24 ins. In some embodiments, the base 120 has a width in a range of 12 to 42 ins. Preferably, the base 120 has a width that is sufficient to accommodate a user (e.g., to accommodate a length of a human foot).

In some embodiments, the base 120 is about 10 ins long. In some embodiments, the base 120 is about 12.5 ins long.

In some embodiments, the base 120 is about 15 ins long. In some embodiments, the base 120 is about 17.5 ins long. In some embodiments, the base 120 is about 20 ins long. In some embodiments, the base 120 is about 24 ins long. In some embodiments, the base 120 is about 30 ins long. In some embodiments, the base 120 is about 36 ins long. In some embodiments, the base 120 is about 42 ins long. In some embodiments, the base 120 is about 48 ins long. In some embodiments, the base 120 is about 54 ins long. In some embodiments, the base 120 is about 60 ins long. In some embodiments, the base 120 is about 66 ins long. In some embodiments, the base 120 is about 72 ins long. In some embodiments, the base 120 is about 78 ins long. In some embodiments, the base 120 is about 84 ins long. In some embodiments, the base 120 has a length in a range of 10 to 84 ins. In some embodiments, the base 120 has a length in a range of 15 to 72 ins. In some embodiments, the base 120 has a length in a range of 15 to 48 ins. In some embodiments, the base 120 has a length in a range of 15 to 40 ins. In some embodiments, the base 120 has a length in a range of 24 to 48 ins. In some embodiments, the base 120 has a length in a range of 24 to 40 ins. Accordingly, in some embodiments the base 120 has a length that is sufficient to accommodate a user in a standing position (e.g., the length of the base is at least as long as a width of a standing user (e.g., shoulder width)) or in prone or laying position.

In some embodiments, a surface area of an upper portion (e.g., upper portion 105) of the base 120 is about 100 square inches ($in^2$). In some embodiments, a surface area of the upper portion 105 (e.g., a cover 150) of the base 120 is about 100 $in^2$. In some embodiments, a surface area of the upper portion 105 of the base 120 is about 150 $in^2$, about 200 $in^2$, about 225 $in^2$, about 400 $in^2$, about 500 $in^2$, about 576 $in^2$, about 600 $in^2$, about 700 $in^2$, about 800 $in^2$, about 900 $in^2$, about 960 $in^2$, about 1000 $in^2$, about 1100 $in^2$, about 1200 $in^2$, about 1300 $in^2$, about 1400 $in^2$, about 1440 $in^2$, about 1500 $in^2$, about 1600 $in^2$, about 1700 $in^2$, about 1728 $in^2$, about 1800 $in^2$, about 1900 $in^2$, about 2000 $in^2$, about 2100 $in^2$, about 2160 $in^2$, about 2200 $in^2$, about 2300 $in^2$, or about 2400 $in^2$. In some embodiments, the base 120 has a surface area in a range of 100 to 7056 $in^2$. In some embodiments, the base 120 has a surface area in a range of 200 to 2500 $in^2$. In some embodiments, the base 120 has a surface area in a range of 225 $in^2$ to 2160 $in^2$. In some embodiments, the base 120 has a surface area in a range of 225 $in^2$ to 1800 $in^2$. In some embodiments, the base 120 has a surface area in a range of 225 $in^2$ to 1728 $in^2$. In some embodiments, the base 120 has a surface area in a range of 225 $in^2$ to 1152 $in^2$. In some embodiments, the base 120 has a surface area in a range of 144 $in^2$ to 7056 $in^2$. In some embodiments, the base 120 has a surface area in a range of 144 $in^2$ to 1440 $in^2$. In some embodiments, the base 120 has a surface area in a range of 225 $in^2$ to 576 $in^2$.

Furthermore, in some embodiments, the base 120 is configured to support a vertical load of about 150 pounds (lbs). In some embodiments, the base 120 is configured to support a vertical load of about 250 lbs, about 500 lbs, about 750 lbs, about 1000 lbs, about 1250 lbs, about 1500 lbs, about 1750 lbs, about 2000 lbs, about 2250 lbs, about 2400 lbs, about 2500 lbs, or about 5000 lbs. In some embodiments, the base 120 is configured to support a vertical load in a range of 100 lbs to 5000 lbs. In some embodiments, the base 120 is configured to support a vertical load in a range of 100 lbs to 3000 lbs. In some embodiments, the base 120 is configured to support a vertical load in a range of 100 lbs to 2500 lbs. In some embodiments, the base 120 is configured to support a vertical load in a range of 500 lbs to 2500 lbs. In some embodiments, the base 120 is configured to support a vertical load in a range of 500 lbs to 2000 lbs. In some embodiments, the base 120 is configured to support a vertical load in a range of 500 lbs to 1000 lbs. In some embodiments, the base 120 is configured to support a vertical load in a range of 1000 lbs to 2500 lbs.

In some embodiments, the base 120 includes one or more legs 122. In some embodiments, the legs 122 of the exercise device 100 are disposed on a side wall of the base 120. Likewise, in some embodiments the legs 122 of the exercise device 100 are disposed on a bottom surface of the base 120. Furthermore, in some embodiments the legs 122 of the exercise device 100 are each partially disposed on a respective side wall of the base 120 and the bottom portion of the base. In some embodiments, the base 120 includes three or more legs 122 (e.g., a tripod of legs). In some embodiments, the base 120 includes four or more legs 122. In some embodiments, the base 120 includes five or more legs 122. Accordingly, the base 120 of the present disclosure includes a number of legs of an appropriate size to support a load of a user. In some embodiments, each leg 122 includes a respective upper portion 124 and a respective lower portion 126. In some embodiments, the upper portion 124 of the leg 122 is removably coupled to the base 120, allowing the base to either lay flat against a surface of an external environment (e.g., lay flat against a ground), or be elevated from the surface of the external environment. In some embodiments, the upper portion 124 of the leg 122 is permanently coupled to the base 120 (e.g., the upper portion of the leg and the base are formed from a single mold or are molded together). Furthermore, in some embodiments the lower portion 126 is removably coupled to the respective upper portion 124 of the corresponding leg 122, which allows for a user to alter a height of the exercise device 100 similar to the above described coupling of the upper portion of the leg. For instance, in some embodiments the lower portion of the leg 126 is press-fitted or screw coupled to the upper portion 142 of the respective leg 122. Furthermore, in some embodiments, each respective leg 122 includes a damper (e.g., damper 610 of FIG. 6) disposed interposing between the leg 122 and an external environment (e.g., the ground) (e.g., interposing between the lower portion 126 of the leg 122 and the ground). Each damper 610 further isolates the exercise device 120 from the environment, which prevents vibrational energy from being transferred to the external environment instead of the user. Additionally, each damper absorbs energy exerted from the user through the device, such as a sudden jump or load that is induced in switching from pulling a load to pushing the load. In some embodiments, each damper 610 includes an elastic material such as a rubber (e.g., ethylene propylene diene methylene (EPDM) rubber), a fabric (e.g., a plurality of fibers, vinyl, latex, polyester, etc.), or a foam (e.g., Styrofoam, auxetic foam, etc.). For instance, in some embodiments each damper 610 includes a silicon material or a combination of silicon and EPDM.

Figure 6:
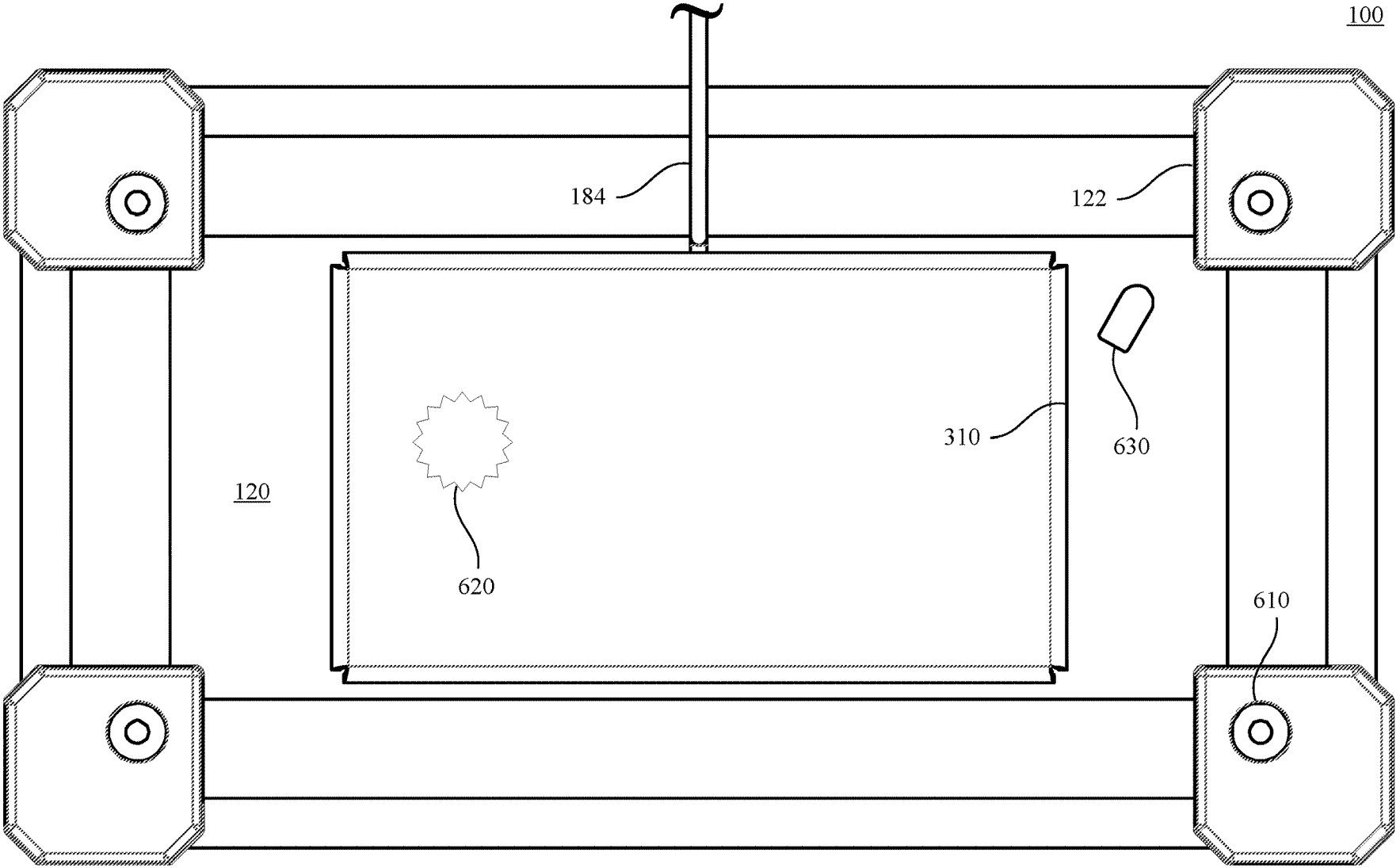
FIG. 6 illustrates a bottom view of an exemplary exercise device, in accordance with an embodiment of the present disclosure.
Figure 7:
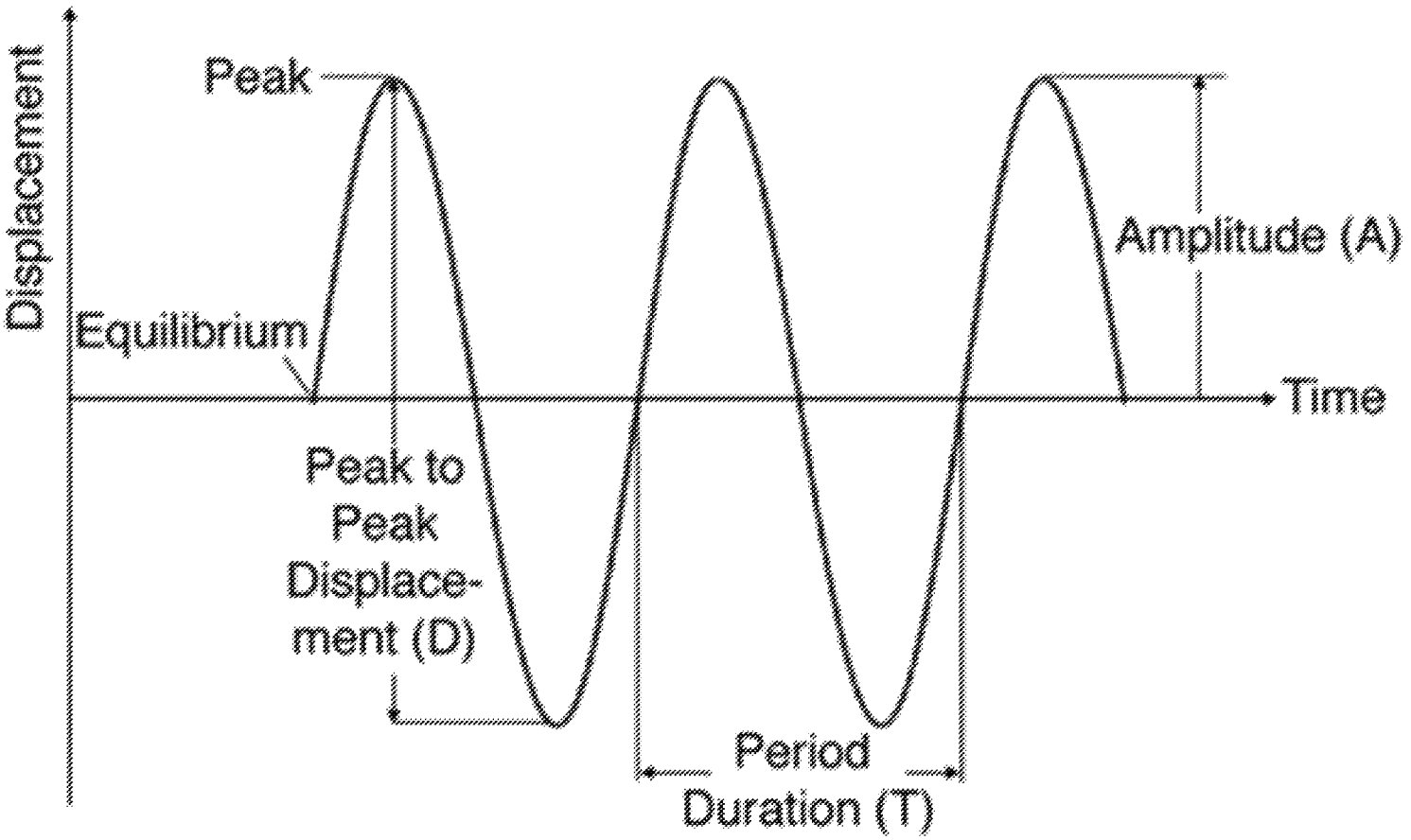
FIG. 7 (Prior Art)
FIG. 7 illustrates a plot of displacement against time in sinusoidal vibration in accordance with the prior art.

In some embodiments, the power mechanism 310 of the exercise device 100, at least, provides electrical power to a vibration mechanism (e.g., vibration mechanism 620 of FIG. 6) that is also disposed on the base 120. In some embodiments, the vibration mechanism 620 is housed within the power mechanism 310. However, the present disclosure is not limited thereto. For instance, in some embodiments the vibration mechanism 620 is disposed on a first surface of the base 120 (e.g., on a bottom surface of the base as depicted in FIG. 6, on a side surface of the base, on an upper surface of the base, etc). In some embodiments, the vibration mechanism 620 is disposed internally within the base 120 (e.g., within an internal portion of the base 120 such as an internal cavity).

In some embodiments, the vibration mechanism 620 includes a motor with an unbalanced load disposed at an end portion thereof (e.g., the vibration mechanism 620 includes an eccentric rotating mass vibration motor (ERM)). In some embodiments, the vibration mechanism 620 includes more than one ERM. However, ensuring that each ERM is synchronized to provide a desired vibration is difficult since the phases of each ERM will, at times, conflict (e.g., oppose each other). In some embodiments, the vibration mechanism 620 includes a mass attached to an oscillating spring (e.g., a linear resonant actuator (LRA)).

In some embodiments, the vibration mechanism 620 provides synchronous vibrations through the device 100 in a first axis. For instance, in some embodiments the vibration mechanism 620 provides synchronous linear vibrations (e.g., a plurality of synchronous linear vibrations having a first amplitude and a first frequency) through the base 120 of the exercise device 100 in a first axis. Moreover, in some embodiments the vibration mechanism provides either a first plurality of linear vibrations having a first amplitude and a first frequency, or a second plurality of vibrations having a second amplitude and/or a second frequency (e.g., in some embodiments the second plurality of linear vibrations include the first amplitude or the first frequency). In some embodiments, this first axis is parallel to a longitudinal axis of a user of the exercise device 100 (e.g., about a vertical orientation). In some embodiments, the base 120 of the exercise device 100 is substantially free of vibration in a plane orthogonal to the first axis (e.g., is substantially free of vibrations in a horizontal plane of the exercise device) a time when the vibration mechanism 620 provides the first plurality of linear vibrations. Additionally, in some embodiments the first plurality of synchronous linear vibrations is of a constant frequency (e.g., a constant frequency of 30 Hertz). In some embodiments, the vibrations consist of linear vibrations of a constant amplitude. In varying embodiments, this constant amplitude is between 0.5 millimeter and 4 millimeters, between 1 millimeter and 3 millimeters, between 1.5 millimeters and 2.5 millimeters, about 2 millimeters, or exactly 2 millimeters. In some embodiments, however, the present disclosure is not limited thereto. For instance, in some embodiments the vibrations provided by the vibration mechanism 620 are provided in a range of frequencies and/or a range of amplitudes (e.g., the vibrations sweep through a range of amplitudes, etc.).

Furthermore, in some embodiments the base 120 of the exercise device 100 is substantially free of rotational vibration in any direction at a time when the vibration mechanism 620 provides the first plurality of linear vibrations. Moreover, in some embodiments, the base 120 of the exercise device 100 is substantially free of vibration in a plane orthogonal to the first axis and is substantially free of rotational vibration in any direction at a time when the vibration mechanism 620 provides the first plurality of linear vibrations. As previously described, without intending to be limited to any particular theory, it is believed that providing a vibration that is parallel to the longitudinal axis of the user replicates impulses and vibrations that are naturally induced (e.g., through walking) while maintaining a stable platform to perform exercises.

In some embodiments, the vibration mechanism 620 provides vibrations with an amplitude of about 0.5 millimeters (mm). In some embodiments, the vibration mechanism 620 provides vibrations with an amplitude of about 1 mm. In some embodiments, the vibration mechanism 620 provides vibrations with an amplitude of about 1.5 mm. In some embodiments, the vibration mechanism 620 provides vibrations with an amplitude of about 2 mm. In some embodiments, the vibration mechanism 620 provides vibrations with an amplitude of about 2.5 mm. In some embodiments, the vibration mechanism 620 provides vibrations with an amplitude of about 3 mm. In some embodiments, the vibration mechanism 620 provides vibrations with an amplitude of about 4 mm. In some embodiments, the vibration mechanism 620 provides vibrations with an amplitude of about 5 mm. In some embodiments, the vibration mechanism 620 provides vibrations with an amplitude of about 6 mm. In some embodiments, the vibration mechanism 620 provides vibrations with an amplitude of about 7 mm. In some embodiments, the vibration mechanism 620 provides vibrations with an amplitude of about 8 mm. In some embodiments, the vibration mechanism 620 provides vibrations with an amplitude in a range of 0.5 to 10 mm. In some embodiments, the vibration mechanism 620 provides vibrations with an amplitude in a range of 0.25 to 5 mm. In some embodiments, the vibration mechanism 620 provides vibrations with an amplitude in a range of 0.5 to 5 mm. In some embodiments, the vibration mechanism 620 provides vibrations with an amplitude in a range of 0.5 to 2 mm. In some embodiments, the vibration mechanism 620 provides vibrations with an amplitude in a range of 0.25 to 2 mm. In some embodiments, the vibration mechanism 620 provides vibrations with an amplitude in a range of 1 to 2 mm. In some embodiments, the vibration mechanism 620 provides vibrations with an amplitude in a range of 1 to 5 mm.

In some embodiments, the synchronous vibration of the vibration mechanism 620 displaces a portion of the device 100 (e.g., a cover 150) by 0.5 mm. In some embodiments, the synchronous vibration of the vibration mechanism 620 displaces a portion of the device 100 by 1 mm. In some embodiments, the synchronous vibration of the vibration mechanism 620 displaces a portion of the device 100 by 1.5 mm. In some embodiments, the synchronous vibration of the vibration mechanism 620 displaces a portion of the device 100 by 2 mm. In some embodiments, the synchronous vibration of the vibration mechanism 620 displaces a portion of the device 100 by 3 mm. In some embodiments, the synchronous vibration of the vibration mechanism 620 displaces a portion of the device 100 by 4 mm. In some embodiments, the synchronous vibration of the vibration mechanism 620 displaces a portion of the device 100 by 5 mm. In some embodiments, the synchronous vibration of the vibration mechanism 620 displaces a portion of the device 100 by 10 mm. In some embodiments, the synchronous vibration of the vibration mechanism 620 displaces a portion of the device 100 by 20 mm. In some embodiments, the synchronous vibration of the vibration mechanism 620 displaces a portion of the device 100 in a range of 0.5 mm to 20 mm. In some embodiments, the synchronous vibration of the vibration mechanism 620 displaces a portion of the device 100 in a range of 0.5 mm to 16 mm. In some embodiments, the synchronous vibration of the vibration mechanism 620 displaces a portion of the device 100 in a range of 1 mm to 16 mm. In some embodiments, the synchronous vibration of the vibration mechanism 620 displaces a portion of the device 100 in a range of 1 mm to 10 mm. In some embodiments, the synchronous vibration of the vibration mechanism 620 displaces a portion of the device 100 in a range of 1 mm to 5 mm. In some embodiments, the synchronous vibration of the vibration mechanism 620 displaces a portion of the device 100 in a range of 2 mm to 4 mm.

In some embodiments, the vibration mechanism 620 provides vibrations with a frequency of about 5 Hertz (Hz). In some embodiments, the vibration mechanism 620 provides vibrations with a frequency of about 10 Hz. In some embodiments, the vibration mechanism 620 provides vibrations with a frequency of about 15 Hz. In some embodiments, the vibration mechanism 620 provides vibrations with a frequency of about 20 Hz. In some embodiments, the vibration mechanism 620 provides vibrations with a frequency of about 25 Hz. In some embodiments, the vibration mechanism 620 provides vibrations with a frequency of about 30 Hz. In some embodiments, the vibration mechanism 620 provides vibrations with a frequency of 30 Hz. In some embodiments, the vibration mechanism 620 provides vibrations with a frequency of about 35 Hz. In some embodiments, the vibration mechanism 620 provides vibrations with a frequency of about 40 Hz. In some embodiments, the vibration mechanism 620 provides vibrations with a frequency of about 45 Hz. In some embodiments, the vibration mechanism 620 provides vibrations with a frequency of about 50 Hz. In some embodiments, the vibration mechanism 620 provides vibrations with a frequency of about 55 Hz. In some embodiments, the vibration mechanism 620 provides vibrations with a frequency of about 60 Hz. In some embodiments, the vibration mechanism 620 provides vibrations with a frequency of about 65 Hz. In some embodiments, the vibration mechanism 620 provides vibrations with a frequency of about 70 Hz. In some embodiments, the vibration mechanism 620 provides vibrations with a frequency in a range of 5 to 70 Hz. In some embodiments, the vibration mechanism 620 provides vibrations with a frequency in a range of 10 to 60 Hz. In some embodiments, the vibration mechanism 620 provides vibrations with a frequency in a range of 10 to 50 Hz. In some embodiments, the vibration mechanism 620 provides vibrations with a frequency in a range of 10 to 40 Hz. In some embodiments, the vibration mechanism 620 provides vibrations with a frequency in a range of 20 to 60 Hz. In some embodiments, the vibration mechanism 620 provides vibrations with a frequency in a range of 20 to 40 Hz. In some embodiments, the vibration mechanism 620 provides vibrations with a frequency in a range of 25 to 45 Hz. In some embodiments, the vibration mechanism 620 provides vibrations with a frequency in a range of 30 to 60 Hz. In some embodiments, the vibration mechanism 620 provides vibrations with a frequency in a range of 25 to 35 Hz.

In some embodiments, an instantaneous acceleration provided by the vibration mechanism 620 to the cover 150 is a gravitational force (g-force) of about 1.5 (e.g., 1.5 g). In some embodiments, an instantaneous acceleration provided by the vibration mechanism 620 to the cover 150 is about 2 g. In some embodiments, an instantaneous acceleration provided by the vibration mechanism 620 to the cover 150 is about 2.5 g. In some embodiments, an instantaneous acceleration provided by the vibration mechanism 620 to the cover 150 is about 3 g. In some embodiments, an instantaneous acceleration provided by the vibration mechanism 620 to the cover 150 is about 3.5 g. In some embodiments, an instantaneous acceleration provided by the vibration mechanism 620 to the cover 150 is about 4 g. In some embodiments, an instantaneous acceleration provided by the vibration mechanism 620 to the cover 150 is about 4.5 g. In some embodiments, an instantaneous acceleration provided by the vibration mechanism 620 to the cover 150 is about 10 g. In some embodiments, an instantaneous acceleration provided by the vibration mechanism 620 to the cover 150 is about 15 g. In some embodiments, the vibration mechanism 620 provides an instantaneous acceleration to a user of the device 100 and/or a component of the device (e.g., the cover 150) in a range of 1 g to 15 g, in a range of 1 g to 5 g, in a range of 1 g to 4 g, in a range of 2 g to 15 g, in a range of 2 g to 10 g, in a range of 2 g to 5 g, or in a range of 2 g to 4 g.

Furthermore, in some embodiments the frequency and/or amplitude of the vibrations provided by the vibration mechanism 620 is controlled by an end user (e.g., via a control mechanism). In some embodiments, the frequency of the vibrations provided by the vibration mechanism 620 is controlled by a first controller (e.g., a mechanism operated by an end user of the device), while the amplitude of the vibrations provided by the vibration mechanism 620 is controlled by a second controller. Further, in some embodiments the frequency of the of the vibrations provided by the vibration mechanism 620 is fixed (e.g., predetermined), while the amplitude of the vibrations provided by the vibration mechanism 620 is controlled by a controller. In some embodiments, the amplitude of the of the vibrations provided by the vibration mechanism 620 is fixed (e.g., predetermined), while the frequency of the vibrations provided by the vibration mechanism 620 is controlled by a controller. Accordingly, the frequency of the vibration mechanism 620 induces a contraction and/or relaxation in the muscles of the exercise at a corresponding rate. For instance, in some embodiments if the vibration mechanism 620 provides vibrations with a frequency of about 65 Hz, muscles of the exercise will contract and/or relax at an approximate frequency, with additional contractions and relaxations promoting muscle growth and rehabilitation. Without intending to be limited to any particular theory, research has suggested that soft tissue naturally responds to a range of input vibration frequencies of 10 to 65 Hz. See, for example, Wakeling et al., 2001, "Modification of soft tissue vibrations in the leg by muscular activity," J. Appl Physiol., 90, pg. 412, which is hereby incorporated by reference. Moreover, the amplitude of the vibration mechanism 620 controls a displacement of a portion of the user and/or a component of the device 100.

Providing vibrations in an axis parallel to the longitudinal axis of the user (e.g., vertical vibrations) allows for small fluctuations to occur within the muscles of the user. A continuous vibrational input forces the soft tissue to vibrate at the same frequency as the input vibration, increasing an efficiency of performing a given exercise. For instance, if a user is at a maximum distance of a repetition in an exercise, the vibrations provided by the vibration mechanism 620 add small movements to the muscles of the user that enhance the efficiency of the exercise. These vibrations vibration help activate the muscle spindle cells within the muscles better since the vibrations mimic natural muscle contractions. The vibrations also activate the postural muscles, which facilitate better muscle balance and coordination.

In some embodiments, the upper portion 105 of the base 120 includes a protrusion 110 that surrounds an outer edge portion of the upper portion. In some embodiments, the protrusion 110 has a height of about 0.5 cm. In some embodiments, the protrusion 110 has a height of about 1 cm. In some embodiments, the protrusion 110 has a height of about 1.5 cm. In some embodiments, the protrusion 110 has a height of about 2 cm. In some embodiments, the protrusion 110 has a height in a range of 0.1 cm to 2.5 cm. In some embodiments, the protrusion 110 has a height in a range of 0.5 cm to 3 cm. In some embodiments, the protrusion 110 has a height in a range of 0.5 cm to 2 cm. In some embodiments, the protrusion 110 has a height in a range of 1 cm to 3 cm. Furthermore, in some embodiments the protrusion 110 surrounds a circumference of the upper portion 105. In some embodiments, the protrusion 110 includes one or more interruptions (e.g., openings formed by a groove 112). In some embodiments, the interruptions of the protrusion 110 correspond with the below described groove 112 (e.g., a length of the interruption is related to a width of the groove 112). Additionally, in some embodiments an upper end portion of the protrusion 110 is either rounded (e.g., a smooth edge) or cornered (e.g., a bevel).

In some embodiments, the upper portion 105 of the base 120 includes a cover 150. The cover 150 is coupled to an upper end portion of the protrusion 110. For instance, in some embodiments the cover 150 is disposed over an upper portion of the protrusion 110 (e.g., the protrusion is encapsulated by the cover). In some embodiments, the cover 150 is disposed within the protrusion 110 (e.g., the cover is accommodated by the protrusion). In some embodiments, the protrusion 110 includes a seat (e.g., a flange) that is configured to accommodate the cover 150. Moreover, in some embodiments the cover 150 is flush (e.g., level) with an upper edge portion of the protrusion 110. Furthermore, in some embodiments the surface of the cover 150 is about 110% of the surface area of the base 120. In some embodiments, the surface of the cover 150 is about 105% of the surface area of the base 120. In some embodiments, the surface of the cover 150 is about 100% of the surface area of the base 120. In some embodiments, the surface of the cover 150 is about 98%, about 96%, about 95%, about 92%, about 90% or about 85% of the surface area of the base 120. In some embodiments, the surface of the cover 150 is between 85 percent and 110 percent of the surface area of the base 120. In some embodiments, the surface of the cover 150 is between 95 percent and 105 percent of the surface area of the base 120. In some embodiments, the dimensions of the cover 150 (e.g., a width of the cover, a length of the cover) are as described above with respect to the base 120.

In some embodiments, the cover 150 is slightly raised above the upper edge portion of the protrusion 110. Accordingly, in some embodiments the cover 150 is compressed to be level with the upper edge portion of the protrusion 110 when a pressure is applied to the cover by a user of the device 100. Nevertheless, in some embodiments, the cover 150 is configured to traverse from a first position to a second position in accordance with an interaction (e.g., an applied pressure) from a user (e.g., the user steps on the cover). Accordingly, the first position is configured to place the device 100 in an active state (e.g., engaged state), while the second position is configured to place the device in a deactivated sate (e.g., unengaged state). In some embodiments, the cover 150 includes one or more grooves 152 that accommodate an elastic band 290. In some embodiments, the grooves 152 of the cover are the same size as a groove 112 of the protrusion 110. For instance, in some embodiments an elastic band 290 is disposed such that it is interposing between the cover 150 and the upper portion 105 (e.g., the protrusion 110 of the upper portion), as will be described in more detail infra.

Figure 2:
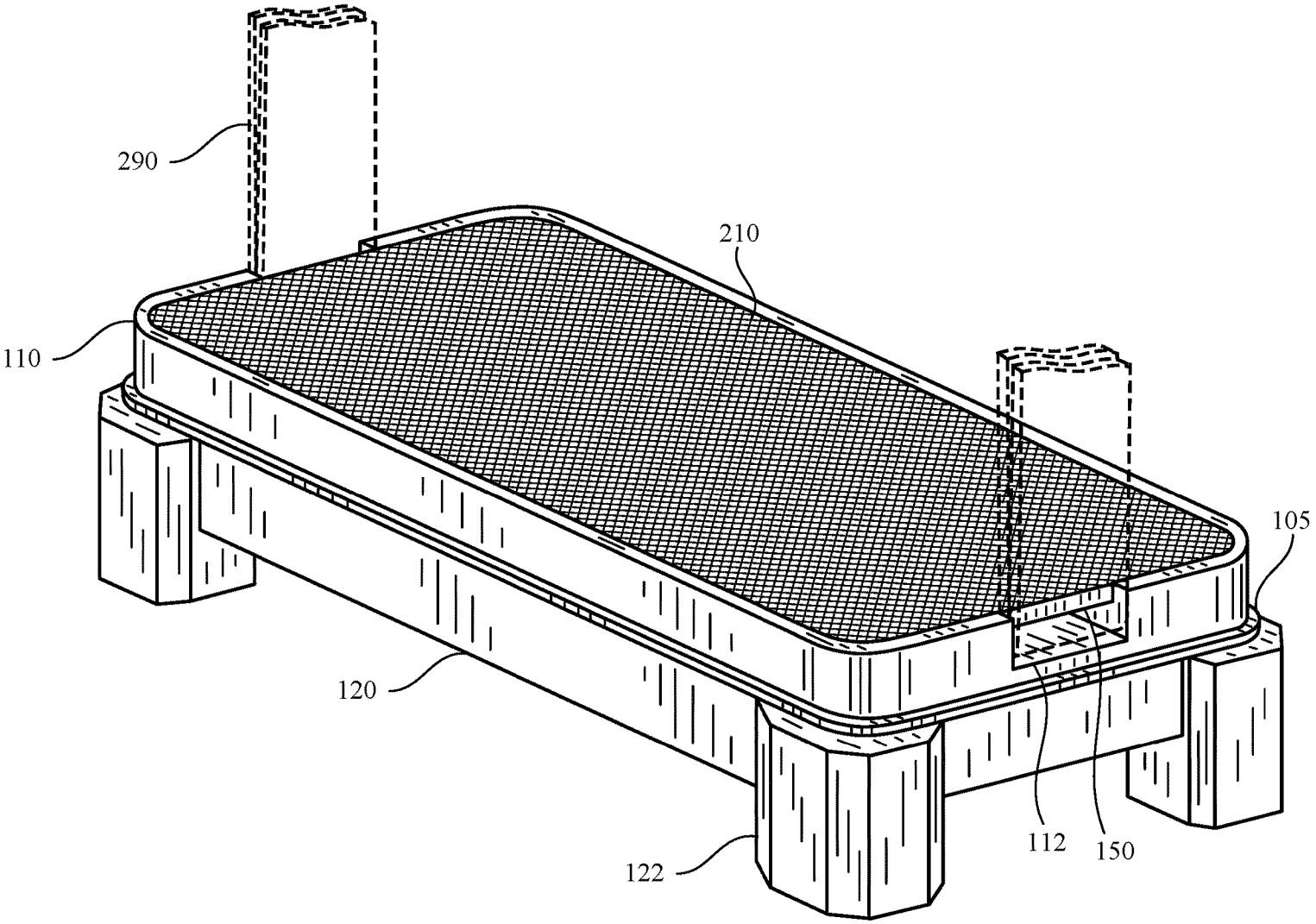
FIG. 2 illustrates an exemplary exercise device, in accordance with an embodiment of the present disclosure.
Figure 3:
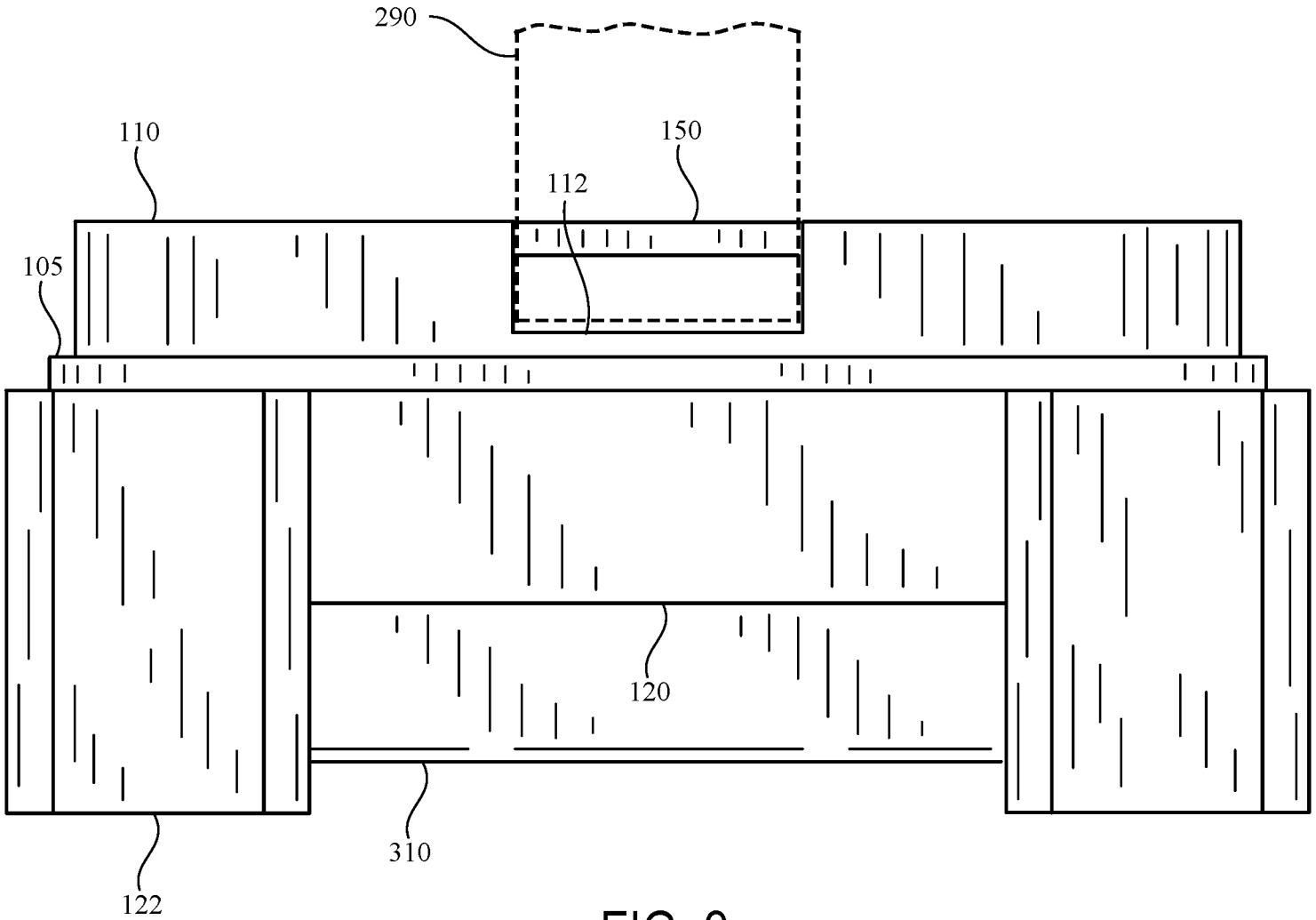
FIG. 3 illustrates a side view of an exemplary exercise device, in accordance with an embodiment of the present disclosure.
Figure 4:
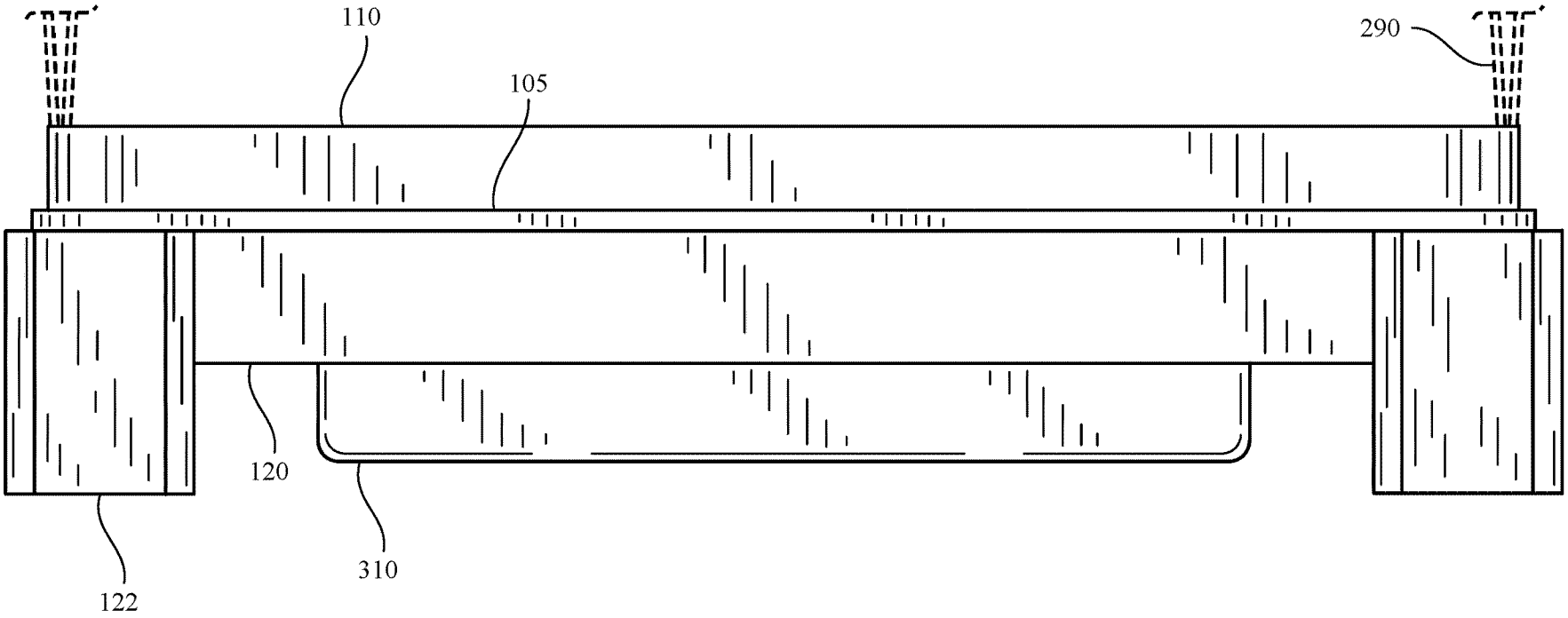
FIG. 4 illustrates a front view of an exemplary exercise device, in accordance with an embodiment of the present disclosure.
Figure 5:
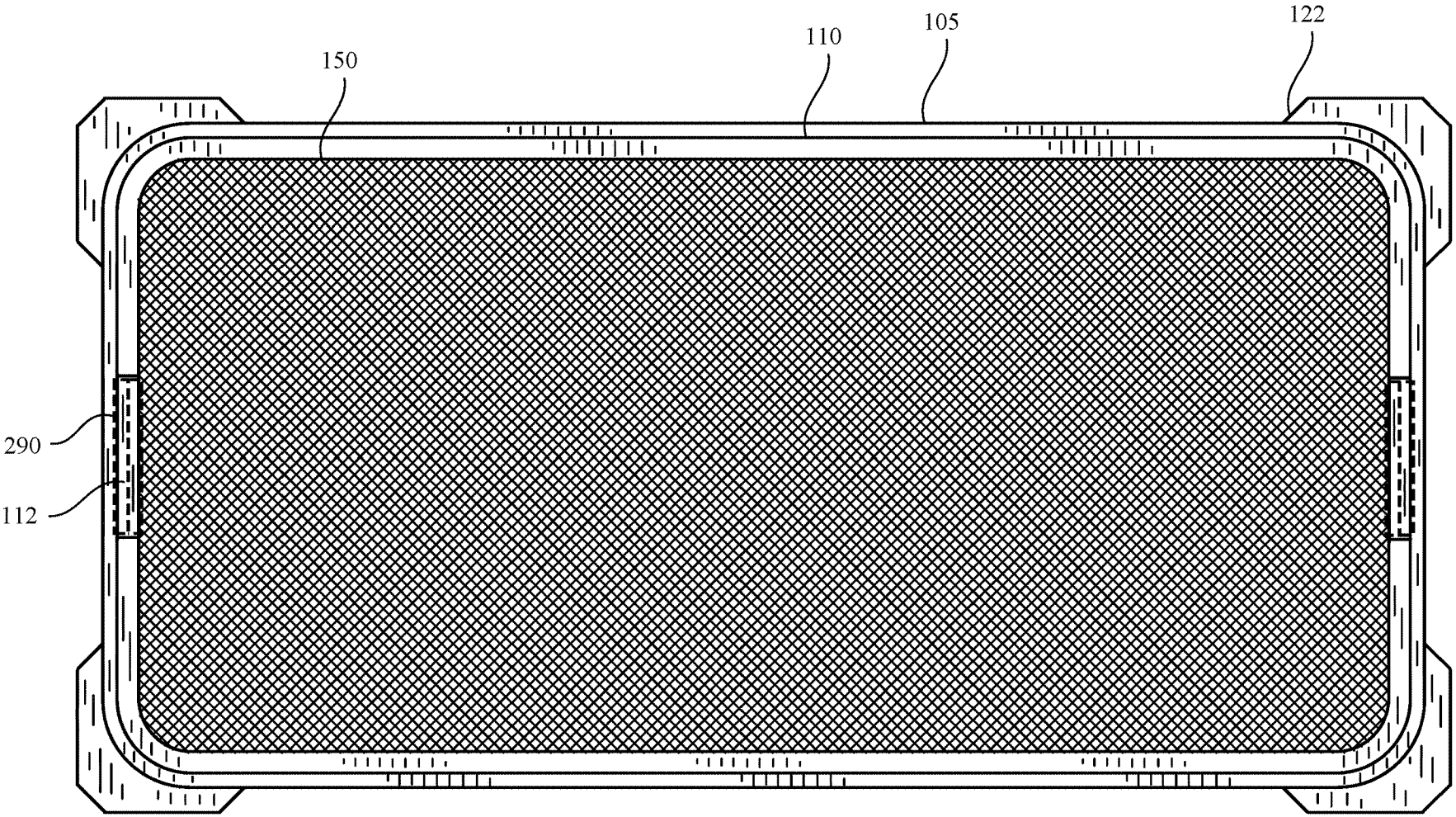
FIG. 5 illustrates a top view of an exemplary exercise device, in accordance with an embodiment of the present disclosure.

In some embodiments, the cover 150 includes a grip surface (e.g., grip surface 210 of FIG. 2). In some embodiments, the grip surface 210 includes a pattern of straight and/or diagonal lines that is either cut into an upper surface of the cover 150 or raised from the upper surface of the cover. In some embodiments, the grip surface 210 includes a material applied to the upper surface of the cover 150 (e.g., a grip tape, a rubber coating, etc.). For instance, in some embodiments the grip surface 210 is coated with GR-S, neoprene, a nitrile rubber, a butyl rubber, a polysulfide rubber, or an ethylene-propylene rubber (e.g., ethylene propylene diene methylene (EPDM) rubber), a cyclized rubber (e.g., Thermoprene). See for example, Sections 6-161 through 6-163 of Marks' *Standard Handbook for Mechanical Engineers*, ninth edition, 1987, McGraw-Hill, Inc., beginning at p. 6.161, which is hereby incorporated by reference. In some embodiments, the grip surface 210 includes a tread and/or a pattern raised on a surface of the cover 150 (e.g., a diamond tread). Furthermore, in some embodiments the cover 150 is made of metal (e.g., aluminum, steel, iron, etc.). In some embodiments, the metal used to make the cover 150 is as described above with respect to the base 120. In some embodiments, the cover 150 includes a rubber material. For instance, in some embodiments, the cover 150 is coated with GR-S, neoprene, a nitrile rubber, a butyl rubber, a polysulfide rubber, or an ethylene-propylene rubber (e.g., ethylene propylene diene methylene (EPDM) rubber), a cyclized rubber (e.g., Thermoprene). See for example, Sections 6-161 through 6-163 of Marks' *Standard Handbook for Mechanical Engineers*, ninth edition, 1987, McGraw-Hill, Inc., beginning at p. 6.161, which is hereby incorporated by reference. Accordingly, the grip surface 210 is configured to enhance an ability of a user to engage with the device 100 without fear of losing contact with the device, particularly while the vibration mechanism 620 of the device is engaged.

In some embodiments, a total height of the exercise device 100 (e.g., a combined height from an external surface (e.g., the ground) to an upper most surface of the device (e.g., the cover 150, the protrusion 100, and/or the upper portion 105)) is in a range of 2 inches to 12 inches. In some embodiments, a total height of the exercise device 100 is in a range of 2.5 inches to 10 inches. In some embodiments, a total height of the exercise device 100 is in a range of 3 inches to 10 inches. In some embodiments, a total height of the exercise device 100 is in a range of 6 inches to 12 inches.

In some embodiments, the protrusion 110 includes a groove 112, which provides a respective opening on a side portions of the device 100 that accommodates an elastic band 290 of varying size. In some embodiments, the groove 112 runs from a first end portion of the base 120 to a second end portion of the base (e.g., from a first side to a second side of the base). For instance, in some embodiments the groove 112 is parallel to a longitudinal axis of the device 100. For instance, in some embodiments the groove 112 accommodates a first elastic band 290 at a first side of the device 100 and a second elastic band 290 at a second side of the device. In some embodiments, a single elastic band 290 is accommodated by the groove 112 and utilized by a user to perform exercises. Accordingly, in some embodiments a width of the groove 112 is about 0.5 cm, about 1 cm, about 1.5 cm, about 2 cm, about 2.5 cm, about 3 cm, about 3.5 cm, about 4 cm, about 4.5 cm, about 5 cm, about 5.5 cm, about 6 cm, about 6.5 cm, about 7 cm, about 7.5 cm, about 8 cm, or about 8.5 cm. In some embodiments, a width of the groove 112 is substantially the same as a width of a first elastic band 290 in a plurality of elastic bands. In some embodiments, the groove 112 has a width in a range of 0.5 cm to 8.5 cm. In some embodiments, the groove 112 has a width in a range of 1 cm to 8.5 cm. In some embodiments, the groove 112 has a width in a range of 1 cm to 7.5 cm. In some embodiments, the groove 112 has a width in a range of 2.5 cm to 8.5 cm. In some embodiments, the groove 112 has a width in a range of 2 cm to 6 cm.

In some embodiments, each elastic band 290 in the one or more elastic bands has a unique elasticity, or similarly maximum resistance. For instance, in some embodiments, the exercise kit of the present disclosure includes two elastic bands 290. The two elastic bands 290 include a first elastic band of a first maximum resistance (e.g., a low maximum resistance such as 5 lbs) and a second band of a second maximum resistance different than the first maximum resistance (e.g., a high resistance such as 100 lbs). In some embodiments, the exercise kit 600 includes at least three exercise bands 290. In some embodiments, the at least three exercise bands 290 of the exercise kit 600 include a first elastic band 290-1 characterized by a first maximum resistance, a second elastic band 290-2 characterized by a second maximum resistance that is greater than the first maximum resistance, and a third elastic band 290-3 having a third maximum resistance that is greater than the second maximum resistance. In some embodiments, a respective maximum resistance of each band 290 is determined, at least in part, by a width and/or thickness of the band (e.g., a lower resistance band includes a thinner width and/or thickness compared to a higher resistance band). For instance, in some embodiments the third band 290-3 has a width is about a same width as the groove 112 (e.g., the width of the third band is of from about 75% to about 100% the width of the groove). In some embodiments, the second band 290-2 has a width is less than the width of the groove 112 (e.g., the width of the second band is of from about 40% to about 75% the width of the groove 112). In some embodiments, the first band 290-1 has a width that is less than the width of the groove 112 (e.g., the width of the first band is of from about 5% to about 40% the width of the groove 112). In some embodiments, the one or more elastic bands 290 of the present disclosure includes a band that is a continuous flat loop (e.g., a rehabilitation band and/or a fit loop band). In some embodiments, the one or more elastic bands 290 of the present disclosure includes a band that has a handle (e.g., an ankle cuff, a hard handle such as plastic, a soft handle such as foam, etc.). In some embodiments, a length of a respective elastic band 290 is about 20 cm. As used herein, a length of a respective elastic band 290 refers to a length of a relaxed elastic band 290 (e.g., the band 290 is not under tension). Furthermore, as used herein, the length of the respective elastic band 290 refers to a length of a closed band (e.g., if a band 290 is a closed loop band with a closed loop length of about 20 cm, when the band is cut so as to sever the loop, a total length of the band is about 40 cm, but as disclosed herein, the closed band loop 20 cm is designated). In some embodiments, a closed band length of a respective elastic band 290 is about 25 cm, about 30 cm, about 35 cm, about 40 cm, about 41 cm, about 45 cm, about 50 cm, about 55 cm, or about 60 cm. In some embodiments, the elastic band 290 has a closed band length in a range of 20 cm to 90 cm. In some embodiments, the elastic band 290 has a closed band length in a range of 20 cm to 60 cm. In some embodiments, the elastic band 290 has a closed band length in a range of 30 cm to 60 cm. In some embodiments, the elastic band 290 has a closed band length in a range of 40 cm to 60 cm. In some embodiments, the elastic band 290 has a closed band length in a range of 40 cm to 50 cm.

In some embodiments, the elastic band 290 has a thickness of about 0.5 mm when the band is in a relaxed state (e.g., no tensile load exerted on the band). In some embodiments, the elastic band 290 has a thickness of about 1.5 mm when the band is in a relaxed state. In some embodiments, the elastic band 290 has a thickness of about 2.5 mm when the band is in a relaxed state. In some embodiments, the elastic band 290 has a thickness of about 3 mm when the band is in a relaxed state. In some embodiments, the elastic band 290 has a thickness of about 3.5 mm when the band is in a relaxed state. In some embodiments, the elastic band 290 has a thickness of about 4 mm when the band is in a relaxed state. In some embodiments, the elastic band 290 has a thickness of about 4.5 mm when the band is in a relaxed state. In some embodiments, the elastic band 290 has a thickness of about 5 mm when the band is in a relaxed state. In some embodiments, the elastic band 290 has a thickness of about 5.5 mm when the band is in a relaxed state. In some embodiments, the elastic band 290 has a thickness of about 6 mm when the band is in a relaxed state. In some embodiments, the elastic band 290 has a thickness of about 6.5 mm when the band is in a relaxed state. In some embodiments, the elastic band 290, in a relaxed state, has a thickness in a range of 0.5 mm to 6.5 mm. In some embodiments, the elastic band 290, in a relaxed state, has a thickness in a range of 1 mm to 6.5 mm. In some embodiments, the elastic band 290, in a relaxed state, has a thickness in a range of 1 mm to 6 mm. In some embodiments, the elastic band 290, in a relaxed state, has a thickness in a range of 1 mm to 5 mm. In some embodiments, the elastic band 290, in a relaxed state, has a thickness in a range of 2 mm to 5.5 mm. In some embodiments, the elastic band 290, in a relaxed state, has a thickness in a range of 2 mm to 5 mm. In some embodiments, the elastic band 290, in a relaxed state, has a thickness in a range of 3 mm to 5.5 mm. In some embodiments, the elastic band 290, in a relaxed state, has a thickness in a range of 3 mm to 5 mm. In some embodiments, the elastic band 290, in a relaxed state, has a thickness in a range of 4 mm to 5.5 mm. In some embodiments, the elastic band 290, in a relaxed state, has a thickness in a range of 4 mm to 8 mm. In some embodiments, the elastic band 290, in a relaxed state, has a thickness in a range of 5 mm to 6 mm.

In some embodiments, a width of the elastic band 290 is about 0.6 ins. In some embodiments, a width of the elastic band 290 is about 0.7 ins. In some embodiments, a width of the elastic band 290 is about 0.8 ins if the band is in a relaxed state (e.g., unextended, relaxed state). In some embodiments, a width of the elastic band 290 is about 0.5 ins, about 0.8 ins, about 1 inch, about 1.1 inches, about 1.2 inches, about 1.3 inches, about 1.4 inches, about 1.5 inches, about 1.6 inches, about 1.7 inches, about 1.8 inches, about 1.9 inches, about 2.0 inches, about 2.1 inches, about 2.2 inches, about 2.3 inches, about 2.4 inches, about 2.5 inches, or about 3.0 inches when the band is in a relaxed state. In some embodiments, the elastic band 290 in a relaxed state has a width in a range of 0.5 inches to 3 inches. In some embodiments, the elastic band 290 in a relaxed state has a width in a range of 1 inch to 3 inches. In some embodiments, the elastic band 290 in a relaxed state has a width in a range of 1 inch to 2.5 inches. In some embodiments, the elastic band 290 in a relaxed state has a width in a range of 1 inch to 2 inches. In some embodiments, the elastic band 290 in a relaxed state has a width in a range of 0.8 inches to 3 inches. In some embodiments, the elastic band 290 in a relaxed state has a width in a range of 0.8125 inches to 2.5 inches. Furthermore, in some embodiments a first elastic band 290-1 of a first width is less resistive to deformation as compared to a second elastic band 290-2 of a second width that is greater than the first width of the first elastic band. Accordingly, in some embodiments a width of the groove 112 is configured to accommodate a widest band that is included in the present disclosure.

Furthermore, in some embodiments the elastic band 290 provides about 25 lbs, about 50, about 100 lbs, about 150 lbs, about 200 lbs, about 250 lbs, about 300 lbs, about 350 lbs, about 400 lbs, about 500 lbs, about 600 lbs, about 700 lbs, about 800 lbs, about 900 lbs, about 1,000 lbs, about 2,000 lbs, about 3,000 lbs, about 4,000 lbs, or about 5,000 lbs of maximum resistance to a user of the device 100. In some embodiments, the elastic band 290 provides between 20 lbs and 60 lbs, between 25 lbs and 90 lbs, between 75 lbs and 125 lbs, between 110 lbs and 180 lbs, between 175 lbs and 240 lbs, between 230 lbs and 280 lbs, between 275 lbs and 325 lbs, between 325 lbs and 375 lbs, between 350 lbs and 425 lbs, between 400 lbs and 475 lbs, between 450 lbs and 650 lbs, or between 650 lbs and 750 lbs of maximum resistance to a user of the exercise device 100.

In some embodiments, the elastic band 290 is made of latex. In particular, in some embodiments the elastic band 290 is made of one or more layers of latex material. In some embodiments, the elastic band 290 consists of about 5 layers, about 10 layers, about 15 layers of a latex, or about 20 layers of a latex. In some embodiments, the elastic band 290 consists of between 3 and 25 layers of latex. In some embodiments, the elastic band 290 consists of between 2 and 8 layers of latex. These layers of latex provide an improved durability to the elastic band 290, which prevents sudden tearing of the elastic band or other abrupt tensile failure. In some embodiments, the elastic band 290 includes a rubber material or a similar elastomer material.

In some embodiments, the power mechanism 310 includes a control mechanism (e.g., mechanism 180 of FIG. 1) that is disposed on the device 100. In some embodiments, the control mechanism 180 is disposed on the upper portion 105 of the base 120. For instance, in some embodiments the control mechanism 180 is disposed such that it is surrounded by the protrusion 110 (e.g., surrounded by the protrusion 110 on the upper portion 105 of the base 120). In some embodiments, the control mechanism 180 is disposed interposing between the upper portion 105 of the base 120 and the cover 150. Accordingly, in some embodiments the state of the control mechanism 180 is determined by a displacement of the cover 150 (e.g., when a user is standing on the cover). In some embodiments, the control mechanism 180 is disposed on a side portion of the base 120. In some embodiments, the control mechanism 180 includes a button or a similar pressure sensitive mechanism (e.g., a pressure sensor) that interrupts a supply of power to one or more components of the exercise bar 100 depending on a state of the control mechanism. For instance, in some embodiments the control mechanism 180 operates the power mechanism 310 between at least a first state (e.g., an on state) and a second state (e.g., an off state). The first state is configured to activate (e.g., supply power to) the vibration mechanism 620 to provide vibrations through the base 120 of the exercise device 100. As previously described, in some embodiments vibrations are synchronous linear vibrations that are provided in a first axis that is parallel to a longitudinal axis of the user of the exercise device that is standing on the exercise device. Thus, the first state is active when the user of the device 100 is engaged with the device (e.g., standing on the base 120 or the cover 150). In embodiments in which the control mechanism 180 is pressure sensitive (e.g., is a button or a pressure sensor), vibrations are only provided when the user is engaged with (e.g., standing on) the device 100. This prevents the device 100 from vibrating unnecessarily, such as when a user is unengaged with the device (e.g., not standing on the device), since otherwise the device would be prone to moving and skittering because the weight of the user is no longer keeping the device stationary.

In some embodiments, the control mechanism 180 is partially disposed in a seat 182 on the upper surface 105 of the device 100. The seat 182 accommodates and allows for the control mechanism 180 to move between a first position (e.g., on) and a second position (e.g., off), where the first and second position each define a state of the device 100, without overly extending from the upper surface 105 of the device 100. For instance, in some embodiments, the first position of the control mechanism is a position in which the button of the control mechanism 180 is fully or partially depressed, while the second position of the control mechanism is a position in which the button of the control mechanism 180 is fully extended, partially extended, or relaxed. In some embodiments, the distance between the first and second position of the control mechanism 180 is less than a displacement provided by vibrations of the vibration mechanism 620. This distance ensures that the control mechanism 180 is not inadvertently operated through the vibrations of the vibration mechanisms 620. Accordingly, if a user applies pressure to the cover 150 (e.g., steps on the cover), the button of the control mechanism 180 is depressed by the cover 150, which places the control mechanism in the first position, supplying power to the vibration mechanism 620 and providing a synchronous vibration to the cover 150. Accordingly, if the user removes pressure from the cover 150 (e.g., steps off the cover), the button of the control mechanism 180 is relaxed, which places the control mechanism 320 in the second position, interrupting power to the vibration mechanism 320. Moreover, in some embodiments, the control mechanism 180 includes a sensor that is configured to detect engagement of the exercise device 100 by a user. In some embodiments, the sensor of the control mechanism 180 is a pressure sensor. Accordingly, the control mechanism 180 in combination with the cover 150 and the protrusion 110 act as a pressure plate to activate the device 100 in accordance with an interaction by a user of the device. In some embodiments, the sensor of the control mechanism 180 is a light sensor (e.g., an IR sensor, a light gate sensor). However, the present disclosure is not limited thereto. In some embodiments, a portion of the control mechanism 180 is disposed on, or exposed through, an upper portion of the cover 150 (e.g., a portion of the button of the control mechanism is exposed through the cover 150). Thus, a user of the exercise device 100, in such embodiments, directly engages with the control mechanism 180 by stepping on the control mechanism instead of the pressure applied through the cover 150. Nevertheless, the control mechanism 180, and in some embodiments in combination with the cover 150, provides automated power control to the vibration mechanism 320, allowing synchronous vibrations to be provided through the device 100 only when a user is engaged with (e.g., standing on) the device.

In some embodiments, the power mechanism 310 includes one or more batteries coupled to the device (e.g., the power mechanism 310 includes one or more batteries). In some embodiments, the power mechanism 310 includes an alternating current (AC) adapter (e.g., adapter 184 of FIG. 1) configured to supply power to the device from a power outlet (e.g., an AC outlet). For instance, in some embodiments the power mechanism 310 and/or the vibration mechanism 620 operates at 110 volts (V), 115 V, 120 V, 127 V, 220 V, 230 V, or 240 V. In some embodiments, the power mechanism 310 and/or the vibration mechanism 620 operates at a range of 120 V to 240 V, 120 V to 230 V, 120 V to 240 V, 110 V to 240 V, or 110 V to 240 V. In some embodiments, the power mechanism 310 and/or the vibration mechanism 620 has a load at a range of 1 to 20 Amps (A), 1 A to 10 A, 2 A to 10 A, or 3 A to 8 A.

Furthermore, in some embodiments, the power mechanism 310 includes a mechanism to control an amplitude and/or a frequency of a vibration provided by the vibration mechanism. Additionally, in some embodiments the vibration mechanism 620 is active (e.g., produces one or more vibrations) while the power mechanism 310 supplies power (e.g., a button of the power mechanism 310 is compressed). In some embodiments, the vibration mechanism 620 is active for a predetermined period of time while the power mechanism 310 supplies power (e.g., a button of the power mechanism is compressed). In some embodiments, the predetermined period of time is about 10 seconds, about 30 seconds, about 60 seconds, or about 120 seconds. In some embodiments, the predetermined period of time is between 5 seconds and 180 seconds. Moreover, in some embodiments the power mechanism 310 includes a power indicator (e.g., an LED light) that indicates if power is supplied to the power mechanism 310 and/or the vibration mechanism 620. Additionally, in some embodiments the exercise device includes a power supply switch (e.g., power supply switch 630 of FIG. 6) that is configured as an ON/OFF mechanism for power mechanism 310 of the exercise device 100. As depicted in FIG. 6, in some embodiments the power supply switch 630 is disposed on a portion of the base 120 adjacent to the power mechanism 310 (e.g., a bottom portion of the base). In some embodiments, the power supply switch 630 is incorporated in the power mechanism 310 (e.g., is disposed on the power mechanism).

In some embodiments, the exercise device 100 has a weight of about 10 lbs, about 15 lbs, about 20 lbs, about 25 lbs, about 45 lbs, about 100 lbs, or about 250 lbs. In some embodiments, the exercise device 100 has a weight in a range of 10 lbs to 250 lbs, 20 lbs to 200 lbs, 10 lbs to 100 lbs, 10 lbs to 50 lbs, 10 lbs to 25 lbs, 15 lbs to 100 lbs, 15 lbs to 50 lbs, 15 lbs to 25 lbs, 5 lbs to 25 lbs, or 5 lbs to 45 lbs. Preferably, the exercise device 100 has a weight that allows the device to be readily lifted by a user (e.g., less than 45 lbs). This allows for the user to move the device from location to location without excessive exertion. Moreover, in some embodiments, the automated power mechanism 310 of the exercise device 100 enables the device to circumnavigate weight requirements that would otherwise restrict conventional exercise devices, since these conventional devices must be heavy enough to prevent movement of the device while the device is vibrating without the user standing on the device.

In some embodiments, the present disclosure provides an exercise kit for performing one or more exercises. In some embodiments, the exercise kit includes an exercise device 100 as described herein, one or more elastic bands 290, and an exercise bar (e.g., a curl bar, an Olympic bar, an exercise bar with an improved handle, etc.). In some embodiments, the exercise kit includes at least three elastic bands 290. For instance, in some embodiments the exercise kit includes a first band 290-1 of a first resistance, a second band 290-2 of a second resistance that is less than the first resistance (e.g., the second band requires less force to deform than the first band), and a third band 290-3 of a third resistance that is less than the second resistance (e.g., the third band requires less force to deform than the second band).

In some embodiments, the present disclosure provides a first band 290-1 that includes a thickness of about 5 mm, a width of about 0.8125 ins, a length of about 41 ins, and about a 100 lbs force production capacity. In some embodiments, the present disclosure provides a second band 290-2 that includes a thickness of about 5 mm, a width of about 1.125 ins, a length of about 41 ins, and about a 160 lbs force production capacity. In some embodiments, the present disclosure provides a third band 290-1 that includes a thickness of about 5 mm, a width of about 1.75 ins, a length of about 41 ins, and about a 240 lbs force production capacity. In some embodiments, the present disclosure provides a fourth band 290-1 that includes a thickness of about 5 mm, a width of about 2.5 ins, a length of about 41 ins, and about a 300 lbs force production capacity.

In some embodiments, the exercise device 100 of the present disclosure provides a platform to perform a variety of exercises. For instance, in some embodiments the device 100 of the present disclosure allows a user to perform a variety of exercises including overhead presses, deadlifts, upright rows, curls, bent rows, leg presses, squats, and other similar push and/or pull exercises.

Advantageously, in some embodiments, the disclosed exercise device is a variable resistance device meaning that the further the elastic band 190 is extended by a user, the more resistance the device will exert. So, for instance, when the user extends a band 190 a first distance beyond the relaxed state of the band 190, the band exerts a first resistance (e.g., 80 pounds). When the user extends the band beyond the first distance to a second distance beyond the first state, the band exerts a second resistance that is greater than the first resistance (e.g., 200 pounds). When the user extends the band beyond the second distance to a third distance beyond the first second distance, the band exerts a third resistance that is greater than the second resistance (e.g., 350 pounds), and so on until the user can no longer exert the band further or the maximum resistance of the band is achieved. In other words, the resistance (tension on the muscle) changes (varies) as the user performs an exercise. The resistance is less when the user starts to perform a repetition and it is most when the user is at the end of the repetition. This is advantageous because the exercise kit provides lower resistance at short exertion distances, where body joints are at risk, and higher resistance at longer exertion distances where improved body mechanics arise. The disclosed variable resistance exercised kit is different than free weights. Free weights, such as barbells and dumbbells, provide a constant resistance.

In some embodiments, the user performs an exercise in which the user initially exerts themselves (e.g., exert an exercise bar) across a full range of motion, for instance between (i) to the region in which the elastic band 190 exerts a high resistance (e.g., the third resistance described above) and (ii) the relaxed state in which the elastic band 190 exerts no or minimal resistance, a series of times until the user can no longer exert themselves across the full range of motion of the elastic band. Next, the user exerts the themselves across an intermediate range of motion, for instance between (i) the region in which the elastic band 190 exerts less than the highest resistance (e.g. the second resistance described above) and (ii) the relaxed state in which the elastic band 190 exerts no or minimal resistance, a series of times until the user can no longer exert themselves across the intermediate range of motion. Next, in some embodiments of the exercise, the user exerts themselves across minimal range of motion, for instance between (i) the region in which the elastic band 190 exerts less than the intermediate resistance (e.g., the first resistance described above) and (ii) the relaxed state in which the elastic band 190 exerts no or minimal resistance, a series of times until the user can no longer exert the exercise bar 100 through the minimal range of motion. At the end of this, the user can no longer exert themselves through any of the above ranges of motion until a later time, that is, the user has achieved absolute fatigue. In this way, through such diminishing ranges of motion, osteogenic stimulus is achieved. As such, a program in which such an exercise is done on a regular basis leads to increased muscle strength.

Furthermore, in some of the devices of the present disclosure, the device provides a vertical vibration through the vibration mechanism 620 to the body of the user while performing exercises. This vibration allows for the muscles of the user to contract and relax a number of times that is a magnitude of order greater than conventional exercises, such as lifting weights on a static platform, further improving muscle growth and rehabilitation. Additionally, the vibrations are activated through user engagement with the exercise device 100 (e.g., when the user steps on the device). This allows for the exercise device 100 to vibrate only when the user is engaged with the device, while also providing a more convenient experience for the user while performing exercises.

What is claimed is:

1. A synchronous vibration exercise device comprising:
a base;
a power mechanism disposed within the base; and
a vibration mechanism, wherein
the vibration mechanism is disposed within the base, and
the power mechanism includes a control mechanism that operates the power mechanism between:
a first state in which the vibration mechanism provides a first plurality of synchronous linear vibrations through the base of the exercise device in a first axis that is parallel to a longitudinal axis of a user of the exercise device when the user is standing on the base, and
a second state in which the vibration mechanism is turned off, and wherein
the control mechanism senses when the user is standing on the base and,
responsive to the user standing on the base, causes the power mechanism to switch from the second state to the first state, and
responsive to the user getting off the base, causes the power mechanism to switch from the first state to the second state.

2. The exercise device of claim 1, wherein
the base includes an upper portion that is configured to accommodate the user of the device, and a lower portion that is configured to abut a surface of an external environment, and wherein the upper portion and the lower portion are molded together.

3. The exercise device of claim 2, wherein the upper portion of the base includes a protrusion that surrounds an outer edge portion thereof.

4. The exercise device of claim 3, further comprising a cover that fits within the protrusion.

5. The exercise device of claim 4, wherein the control mechanism of the power mechanism is disposed interposing the upper portion of the base and the cover.

6. The exercise device of claim 5, wherein the control mechanism includes a button, and wherein
a first position of the button causes the power mechanism to be in the first state, and
a second position of the button causes the power mechanism to be in the second state.

7. The exercise device of claim 6, wherein the button is partially disposed in a seat on an upper surface of the base.

8. The exercise device of claim 5, wherein
the control mechanism includes a pressure sensor,
a first pressure signal is detected by the pressure sensor when the user stands on the base, thereby causing the power mechanism to be in the first state, and
a second pressure signal is detected by the pressure sensor when the user gets off the base, thereby causing the power mechanism to be in the second state.

9. The exercise device or claim 4, wherein the cover includes a grip surface.

10. The exercise device of claim 3, wherein the upper portion of the base includes a groove running from a first end portion of the base to a second end portion of the base and wherein the groove includes a first interruption of the protrusion at the first end portion of the base and a second interruption of the protrusion at the second end portion of the base.

11. The exercise device of claim 10, wherein the groove is configured to accommodate one or more elastic bands.

12. The exercise device of claim 11, wherein a first elastic band in the one or more elastic bands has a thickness of at least 1 cm and a length of between 180 centimeters and 220 centimeters when the first elastic band is in an unextended state.

13. The exercise device of claim 12, wherein the groove has a width of from about 2 cm to about 6 cm and wherein the first elastic band fits within the width of the groove and through the first interruption and the second interruption.

14. The exercise device of claim 2, wherein the lower portion of the base includes a plurality of legs.

15. The exercise device of claim 14, wherein each leg in the plurality of legs includes a damper.

16. The exercise device of claim 14, wherein each leg in the plurality of legs includes an upper portion that is coupled to the base and a lower portion that is coupled to the upper portion of the respective leg and abuts the surface of the external environment.

17. An exercise kit comprising:
the exercise device of claim 1;
an exercise bar; and
one or more elastic bands, wherein an elastic band in the one or more elastic bands removably couples the base to the exercise bar.

18. The exercise kit of claim 17, wherein the one or more elastic bands comprises at least three elastic bands, wherein each respective elastic band in the at least three elastic bands has a corresponding different maximum deforming resistance.

19. The exercise device of claim 1, wherein the base is free of vibration in a plane orthogonal to the first axis and is free of rotational vibration in any direction at a time when the power mechanism is in the first state.

20. The exercise device of claim 1, wherein the vibration mechanism operates
at a frequency of between 10 Hertz (Hz) and 60 Hz, when the power mechanism is in the first state, and
at a frequency of 0 Hz when the power mechanism is in the second state.

* * * * *